US006941994B2

(12) United States Patent
Kushihashi et al.

(10) Patent No.: US 6,941,994 B2
(45) Date of Patent: Sep. 13, 2005

(54) SPLICING TAPE FOR SPLICING WEBS USED AS WRAPPING MATERIAL FOR ROD-LIKE ARTICLE TOGETHER AND FEEDING DEVICE OF THE SAME

(75) Inventors: Shigenobu Kushihashi, Tokyo (JP); Junichi Nagai, Tokyo (JP); Hisao Suzuki, Tokyo (JP); Fumio Kubo, Tokyo (JP); Syozo Horikawa, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/816,825

(22) Filed: Apr. 5, 2004

(65) Prior Publication Data

US 2004/0188029 A1 Sep. 30, 2004

Related U.S. Application Data

(63) Continuation of application No. PCT/JP02/10708, filed on Oct. 16, 2002.

(30) Foreign Application Priority Data

Oct. 16, 2001 (JP) ..... 2001-318190
Dec. 18, 2001 (JP) ..... 2001-384737

(51) Int. Cl.[7] ..... B65H 21/00; B31F 5/06

(52) U.S. Cl. ..... 156/505; 156/157; 156/502; 242/555.4; 242/556.1

(58) Field of Search ..... 156/159, 505, 156/157, 502, 504; 242/555, 555.3, 555.4, 556.1

(56) References Cited

U.S. PATENT DOCUMENTS

| | | | | |
|---|---|---|---|---|
| 3,198,452 A | | 8/1965 | Buettel | |
| 3,896,820 A | | 7/1975 | Ludszeweit et al. | |
| 4,038,121 A | * | 7/1977 | Benson et al. | 156/157 |
| 4,124,436 A | * | 11/1978 | Pettis et al. | 156/542 |
| 4,131,501 A | * | 12/1978 | Bottcher et al. | 156/157 |
| 4,371,418 A | * | 2/1983 | Krywiczanin et al. | 156/497 |
| 4,840,694 A | * | 6/1989 | Brookman et al. | 156/344 |
| 5,011,561 A | | 4/1991 | Carolus et al. | |
| 5,057,347 A | | 10/1991 | Alvin | |
| 5,385,622 A | * | 1/1995 | Klingebiel | 156/157 |
| 5,405,470 A | * | 4/1995 | Held | 156/159 |
| 5,692,699 A | | 12/1997 | Weirauch et al. | |
| 5,750,217 A | * | 5/1998 | Kearby et al. | 428/34.8 |
| 5,996,927 A | | 12/1999 | Weirauch et al. | |
| 6,024,148 A | * | 2/2000 | Saitoh et al. | 156/361 |
| 6,422,282 B1 | * | 7/2002 | Meinke | 156/505 |

FOREIGN PATENT DOCUMENTS

| | | | |
|---|---|---|---|
| EP | 0 273 287 A2 | | 7/1988 |
| EP | 1177997 | * | 2/2002 |
| GB | 2 035 966 A | | 6/1980 |
| GB | 2 135 283 A | | 8/1984 |
| JP | 53-78308 A | | 7/1978 |
| JP | 5-65156 A | | 3/1993 |
| JP | 6-199452 A | | 7/1994 |
| JP | 8-231094 A | | 9/1996 |
| WO | WO00/13997 | * | 3/2000 |

* cited by examiner

*Primary Examiner*—Mark A. Osele
(74) *Attorney, Agent, or Firm*—Birch, Stewart, Kolasch & Birch, LLP

(57) ABSTRACT

A double-faced splicing tape of the present invention splices a first web used for forming a tobacco rod and a second web in a stand-by state to and has a plurality of perforations extending in a longitudinal direction of the webs. Furthermore, the present invention provides a feeding device for making the double-faced splicing tape hang toward a feeding position located in between a main delivery path of the first web and a sub-delivery path of the second web.

4 Claims, 8 Drawing Sheets

SPLICING TAPE FOR SPLICING WEBS USED AS WRAPPING MATERIAL FOR ROD-LIKE ARTICLE TOGETHER AND FEEDING DEVICE OF THE SAME

This application is a Continuation of co-pending PCT International Application No. PCT/JP02/10708 filed on Oct. 16, 2002, which designated the United States, and on which priority is claimed under 35 U.S.C. § 120, which claims priority under 35 U.S.C. § 119(a) on Patent Application No(s). 2001-318190 and 2001-384737 filed in JAPAN on Oct. 16, 2001 and Dec. 18, 2001, the entire contents of which are hereby incorporated by reference.

TECHNICAL FIELD

The present invention relates to a splicing tape for splicing various webs together, that are used, for example, in the manufacture of filter cigarettes and a device for feeding the splicing tape toward a web delivery path.

BACKGROUND ART

Webs used in the manufacture of filter cigarettes include a web for wrapping paper used for wrapping shredded tobacco or filter materials, a web for tip paper used for connecting a cigarette to a filter, and so on. Although each of these webs is drawn from a web roll toward a cigarette-manufacturing machine or a filter cigarette-manufacturing machine, there is a limit to the length of web forming the web roll.

Therefore, in order to enable the continuous operation of the above-mentioned manufacturing machine, the manufacturing machine is provided with an automatic splicing device of webs. This automatic splicing device allows a web to be drawn from a standby web roll, not from an active web roll, when a web-remaining amount of the active web roll reaches the prescribed amount or less. Specifically, the automatic splicing device splices the first web being drawn from the active web roll and the second web of the standby web roll by using a splicing tape, and cuts the first web upstream from the splicing tape immediately after the splicing. Accordingly, the manufacturing machine is then supplied with the web from the standby web roll, not from the active web roll, and thus the standby web roll becomes an active one.

The aforementioned automatic splicing device generally splices the first and second webs together by using the splicing tape while the delivery of both the first and second webs is halted. An automatic splicing device of this type, however, requires a reservoir for the first web. The reservoir is located in between the manufacturing machine and the automatic splicing device. In advance of operation of the automatic splicing device, the first web is drawn at a higher speed than a consumption speed in the manufacturing machine side, thus being stored in the reservoir by a given length. As a result, the manufacturing machine can consume the web stored in the reservoir during the operation of the automatic splicing device, which enables the continuous operation of the manufacturing machine.

The use of the reservoir causes all sorts of problems to the web, including the entanglement of webs in the reservoir, a breakage created in side edges of the web, a fracture in the web, etc. The faster the operation speed of the manufacturing machine, or the delivery speed of the first web, becomes, the more often these problems arise.

To avoid the above-listed problems, the development of an automatic splicing device requiring no reservoir has advanced. With such an automatic splicing device, the second web is drawn at the same speed as the delivery speed of the first web and passes a splicing area adjacent to the first web. In this state, when the first and second webs overlap each other with a double-faced splicing tape therebetween, the double-faced splicing tape splices the first and second webs together. Immediately after the splicing, the first web is cut upstream from the double-sided splicing tape, whereas the second web is cut downstream therefrom.

In order to splice the first and second webs together by the above-described splicing manner, when the double-faced splicing tape is fed to the splicing area between the first and second webs, the splicing tape must be kept in a stable state while the first and second webs are delivered. If the double-faced splicing tape flaps in a large way because of the air flow created by the travel of the first and second webs, the double-faced splicing tape may adhere to either web before the first and second webs are overlapped each other, which precludes the splicing of the first and second webs.

The flapping of the double-faced splicing tape could be prevented by diminishing the flexibility of the double-faced splicing tape. Although such a hard double-faced splicing tape is effective for the aforementioned splicing manner, it also lowers the flexibility of webs themselves on a large scale.

In the case that the web is wrapping paper used in a cigarette-manufacturing machine, shredded tobacco is wrapped in the web to be formed into a tobacco rod. The tobacco rod has a seam, which is formed by overlapping both side edges of the web with an adhesive therebetween.

In this case, when the slicing portion of the first and second webs with the double-faced splicing tape therebetween is fed to the cigarette-manufacturing machine, the slicing portion of the first and second webs wraps the shredded tobacco with the bending of the double-faced splicing tape. When a restoring force of the double-faced splicing tape, that acts against the bending thereof, overcomes an adhesive force of the seam of the tobacco rod, the seam comes loose, thereby preventing the continuous forming of the tobacco rod in the cigarette-manufacturing machine.

DISCLOSURE OF THE INVENTION

An object of the present invention is to provide a splicing tape suitable for an automatic splicing device of a splicing manner in which a reservoir is not utilized and a feeding device of the splicing tape.

To achieve the above object, a splicing tape of the present invention has longitudinal rigidity with respect to a direction along a longitudinal direction of a first and a second web and width rigidity with respect to a direction along a width direction of the first and the second web, the width rigidity being smaller than the longitudinal rigidity.

The splicing tape of the present invention is flexible more in the direction along the width direction of the first and second webs than in the direction along the longitudinal direction of the webs. Therefore, even if a filler is wrapped into a rod shape by the splicing portion of the first and second webs so that the splicing tape is formed into a tube, the splicing tape never adversely affects the continuous forming of rod-like article because of weakness of the restoring force thereof.

Specifically, the splicing tape is a double-faced splicing tape to be located between the first and second webs to splice the webs together. In this case, the first and second webs can be spliced to each other by the double-faced splicing tape while being delivered at the same speed, which enables the automatic splicing of the first and second webs without a reservoir.

The splicing tape has a large number of cuts, which are arranged on a prescribed pattern. Specifically, the cuts are a plurality of perforations or a plurality of slits, extending in the longitudinal direction of the first and second webs. Such perforations or slits make the splicing tape flexible in the width direction thereof.

A feeding device of the splicing tape according to the present invention is incorporated into an automatic splicing device for webs. The automatic splicing device splices a first web being delivered from an active roll along main delivery path for wrapping a filling material into a rod shape and a second web drawn from a standby roll in a stand-by state along a sub-delivery path with a splicing tape fed from the feeding device between the first and second webs, and then cuts the first web upstream from a splicing portion of the first and second webs. The main delivery path and the sub-delivery path have a feeding position for receiving supply of the splicing tape.

The feeding device of the present invention comprises a feeding reel wound with a web-like base material, the base material having a large number of splicing tapes attached thereto at prescribed intervals in a longitudinal direction thereof, a take-up reel capable of taking up the base material drawn from the feeding reel, a feeding path extending between the feeding reel and the take-up reel to guide the base material, and driving means for feeding every given length of the base material from the feeding reel by controlling rotation of the take-up reel, the feeding path including a peeling member located above the feeding position, the peeling member having a sharp tip directed to the feeding position, thus peeling one splicing tape off the base material and making the splicing tape hang from the base material toward the feeding position when the base material passes the tip of the peeling member.

According to the feeding device of the present invention, when the base material passes the tip of the peeling member, the base material is folded back at the tip of the peeling member. Therefore, even if the splicing tape has relatively high rigidity, the splicing tape is peeled off the base material to hang from the tip of the peeling member without fail. As a consequence, even though the feeding position of the splicing tape is located in a narrow space between the first and second webs, it is possible to feed the splicing tape to the feeding position in a steady and secure manner.

The splicing tape has the longitudinal rigidity in the direction along the longitudinal direction of the first and second webs and the width rigidity in the direction along the width direction of the first and second webs, the width rigidity being smaller than the longitudinal rigidity. In this case, the splicing tape never adversely affects the continuous forming of rod-like articles.

Furthermore, it is desirable that the splicing tape be a double-faced splicing tape that lies between the first and second webs to splice the webs together. In this case, the automatic splicing device delivers the second web at the same speed as the delivery speed of the first web, splices the first and second webs together through a hanging double-sided splicing tape, and then cut the second web downstream from the splicing portion simultaneously with the cutting of the first web.

The above-described automatic splicing device is capable of automatically splicing the first and second webs without a reservoir for the first web.

The feeding device may further include an air nozzle situated near the tip of the peeling member. The air nozzle jets air from the downstream side of the tip thereto in view of a feeding direction of the base material. The jetted air encourages the peeling of the splicing tape off the base material.

Moreover, the feeding device may have an operating position located right above the feeding position and a retreating position situated away from the feeding position. In this case, after the splicing of the first and second webs is completed, the feeding device is shifted from the operating position to the retreating position, thereby facilitating subsequent arrangement work of the automatic splicing device.

BEST MODE OF CARRYING OUT THE INVENTION

Figure 1:
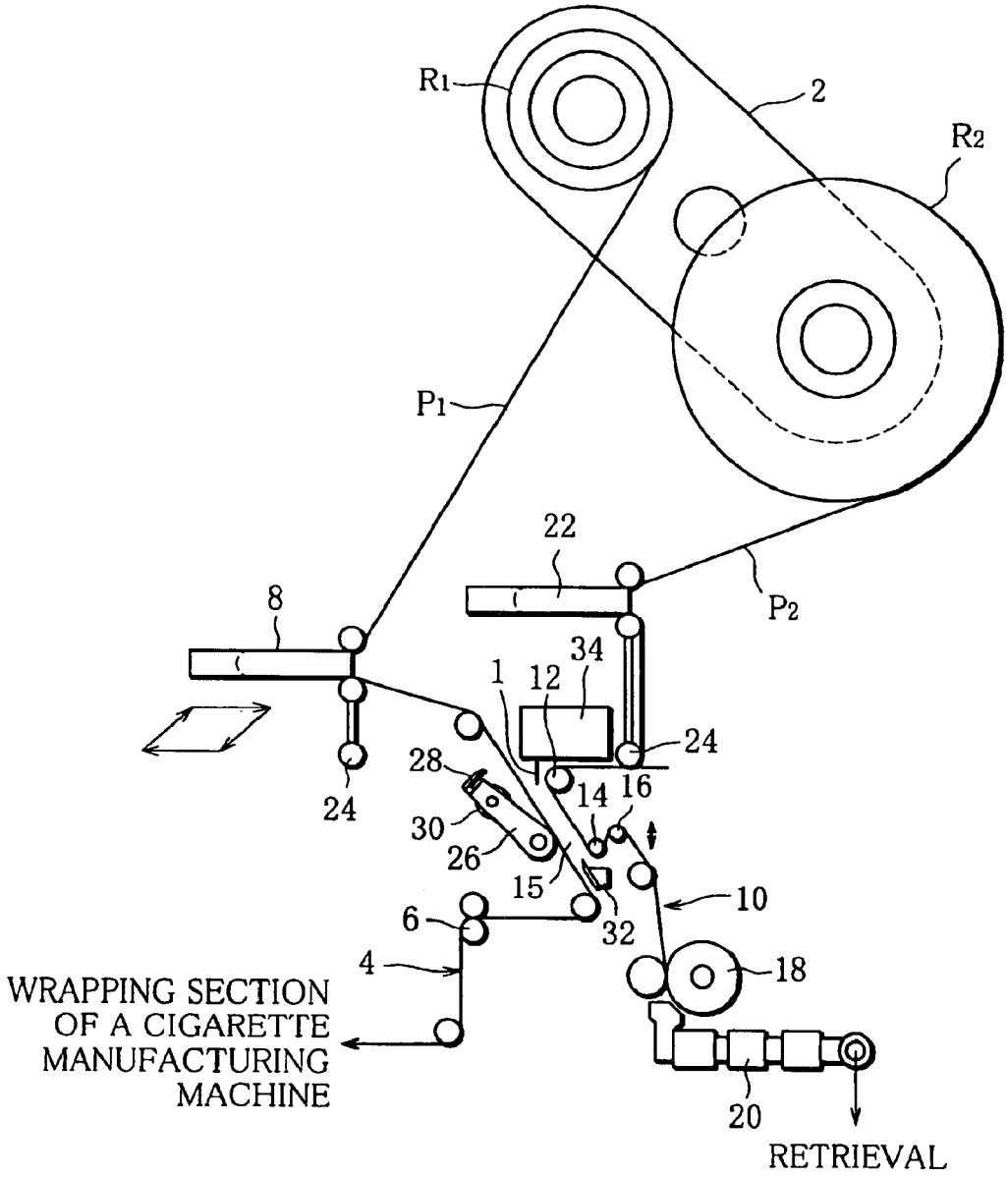
FIG. 1 is a schematic front view of an automatic splicing device for webs used in a cigarette-manufacturing machine.

Referring to FIG. 1, an automatic splicing device for a cigarette-manufacturing machine comprises a pair of web rolls R, which are rotatably supported by both ends of a turning arm 2. More specifically, each web roll R is fixed to an output shaft of a drive motor (not shown), and is capable of rotating individually. In FIG. 1, the left web roll is an active roll $R_1$, and the right web roll a standby roll $R_2$.

A first web $P_1$ of the active roll $R_1$ can be delivered along a prescribed main delivery path 4 extending to a wrapping section of a cigarette-manufacturing machine. Specifically, a main feed roller 6 with a pinch roller is interposed in the main delivery path 4. The main feed roller 6 is located at the wrapping section side and delivers the first web $P_1$ from the active roll $R_1$ toward the wrapping section in sync with rotation of the active roll $R_1$ that is caused by the drive motor.

The wrapping section is supplied with shredded tobacco in addition to the first web $P_1$. The shredded tobacco is wrapped in the first web $P_1$ in a process of passing the wrapping section with the first web $P_1$, thus continuously forming a tobacco rod. The tobacco rod delivered from the wrapping section is then cut into pieces of given length, which forms cigarette rods.

Further interposed in the main delivery path 4 is a buffer unit 8 of a suction type, the buffer unit 8 being situated at the active roll $R_1$ side. The buffer unit 8 is capable of sucking the first web $P_1$ by suction so as to form the first web $P_1$ into a U shape. A suction amount of the first web $P_1$ is detected by a detector (not shown). Based on the result of the detection, rotational speed of the drive motor, or that of the active roll $R_1$, is controlled to maintain tension of the first web $P_1$ at a constant level.

On the other hand, a sub-delivery path 10 extends from the standby roll $R_2$, and the second web $P_2$ is drawn from the standby roll $R_2$ along the sub-delivery path 10. Interposed in the sub-delivery path 10 are a receiving roller 12 and a guide roller 14, the rollers 12 and 14 being each located in the vicinity of the main delivery path 4. More specifically, the receiving roller 12 and the guide roller 14 are arranged away from each other in a vertical direction parallel with the main delivery path 4. The second web $P_2$ extends from the receiving roller 12 to the guide roller 14 closely in parallel with the first web $P_1$. Such a region where the first and second webs $P_1$ and $P_2$ run in parallel with each other defines a splicing passage 15.

The sub-delivery path 10 further includes a movable guide roller 16 located near and above the guide roller 14. The movable guide roller 16 is kept at a rest position shown in FIG. 1 by latch engagement (not shown). When the latch engagement is released, the movable guide roller 16 can be lowered from the rest position.

There is disposed a sub-feed roller 18 with a pinch roller at a terminal end of the sub-delivery path 10. The sub-feed roller 18 delivers the second web $P_2$ from the standby roll $R_2$ in sync with rotation of the standby roll $R_2$ that is caused by the drive motor. The second web $P_2$ is sucked into a suction tube 20 after passing the sub-feed roller 18, and is retrieved through the suction tube 20.

Furthermore, a buffer unit 22 similar to the buffer unit 8 is interposed in the sub-delivery path 10, the buffer unit 22 being situated in between the standby roll $R_2$ and the receiving roller 12. Accordingly, the second web $P_2$ drawn from the standby roll $R_2$ is sucked into the buffer unit 22 so as to have a U shape.

The sub-feed roller 18 is capable of delivering the second web $P_2$ from the standby roll $R_2$ in sync with the rotation of the standby roll $R_2$ that is caused by the drive motor. In this case, the rotational speed of the drive motor of the standby roll $R_2$ is controlled to maintain tension of the second web $P_2$ at a constant level on the basis of the suction amount of the second web $P_2$ sucked into the buffer unit 22.

As illustrated in FIG. 1, the buffer units 8 and 22 have their respective guide rollers 24. Each guide roller 24 is situated outside a unit case of the buffer unit thereof to guide the feeding of the second web $P_2$.

More specifically, as is obvious from FIG. 1, the buffer units 8 and 22 are arranged away from each other not only in the vertical direction but also in a horizontal direction. The buffer units 8 and 22 are capable of moving back and forth and from side to side within a horizontal plane together with their respective guide rollers 24. Therefore, block motion of the buffer units 8 and 22 allows the buffer unit 8 to move to a position under the buffer unit 22 and the buffer unit 22 to move to a position above the buffer unit 8 without causing the buffer units 8 and 22 to interfere with each other.

In a state illustrated in FIG. 1, the guide roller 24 of the buffer unit 22 guides the second web $P_2$. However, the guide roller 24 of the buffer unit 8 can guide the second web $P_2$ when being located above the receiving roller 12.

On the other hand, there is disposed a cutting lever 26 close to the main delivery path 4, and the main delivery path 4 passes between the cutting lever 26 and the receiving roller 12. The cutting lever 26 has a lower end that is rotatably supported, and thus can rotate toward the receiving roller 12. The cutting lever 26 includes a movable cutter 28 at an upper end thereof and supports a press roller 30 rotatably on the underside of the movable cutter 28. When the cutting lever 26 is rotated toward the receiving roller 12, the first and second webs $P_1$ and $P_2$ are sandwiched between the press roller 30 and the receiving roller 12.

Furthermore, there is disposed a fixed cutter 32 under the guide roller 14, the fixed cutter 32 being located at an outlet of the splicing passage 15 in a running direction of the first web $P_1$.

On the other hand, a feeding device 34 of the splicing tape is situated right above the receiving roller 12. The feeding device 34 is capable of hanging the double-faced splicing tapes one by one at an inlet of the splicing passage 15. The feeding device 34 will be described later in detail.

When a remaining amount of the active roll $R_1$ reaches a prescribed amount or less, the sub-feed roller 18 is rotated. The sub-feed roller 18 delivers the second web $P_2$ in sync with the rotation of the standby roll $R_2$ that is caused by the drive motor. Meanwhile, the feeding device 34 hangs one double-faced splicing tape 1 at the inlet of the splicing passage 15, that is, in the vicinity of the receiving roller 12.

Thereafter, once delivery speed of the second web $P_2$ coincides with that of the first web $P_1$, the cutting lever 26 is made to rotate toward the receiving roller 12. Moreover, the press roller 30 of the cutting lever 26 holds the first and second webs $P_1$ and $P_2$ tight with the double-faced splicing tape 1 therebetween in cooperation with the receiving roller 12. In this way, the double-faced splicing tape 1 splices the first and second webs $P_1$ and $P_2$ together.

Simultaneously with the splicing of the first and second webs $P_1$ and $P_2$, the movable cutter 28 of the cutting lever 26 cuts the first web $P_1$ upstream from the splicing passage 15 in cooperation with a cutter receiver located at the feeding device 34 side.

At the same time, in conjunction with the rotation of the cutting lever 26, the latch engagement of the movable guide roller 16 is released, which lowers the movable guide roller 16. Such lowering of the movable guide roller 16 creates flexure in the second web $P_2$. Accordingly, a region of the second web $P_2$, that is downstream from the splicing portion of the first web $P_1$ and the second web $P_2$, is pulled toward both sides of the fixed cutter 32, that is, both directions of the main feed roller 6 side and the sub-feed roller 18 side at the same time to be cut by the fixed cutter 32. As a result, delivered then to the wrapping section of the cigarette-manufacturing machine is not the first web $P_1$ but the second web $P_2$, and the web delivery is switched from the active roll $R_1$ to the standby roll $R_2$.

After the automatic splicing of the webs is finished, the turning arm 2 for the web rolls $R_1$ and $R_2$ is rotated clockwise in FIG. 1, thus switching the web rolls $R_1$ and $R_2$. Accordingly, the standby roll $R_2$ then serves as an active roll, and the used web roll $R_1$ is exchanged for a new web roll, which will serve as a standby roll. When the web rolls are counterchanged in this manner, the buffer units 8 and 22 are moved in conjunction with the rotation of the turning arm 2 without interfering with each other.

Figure 2:
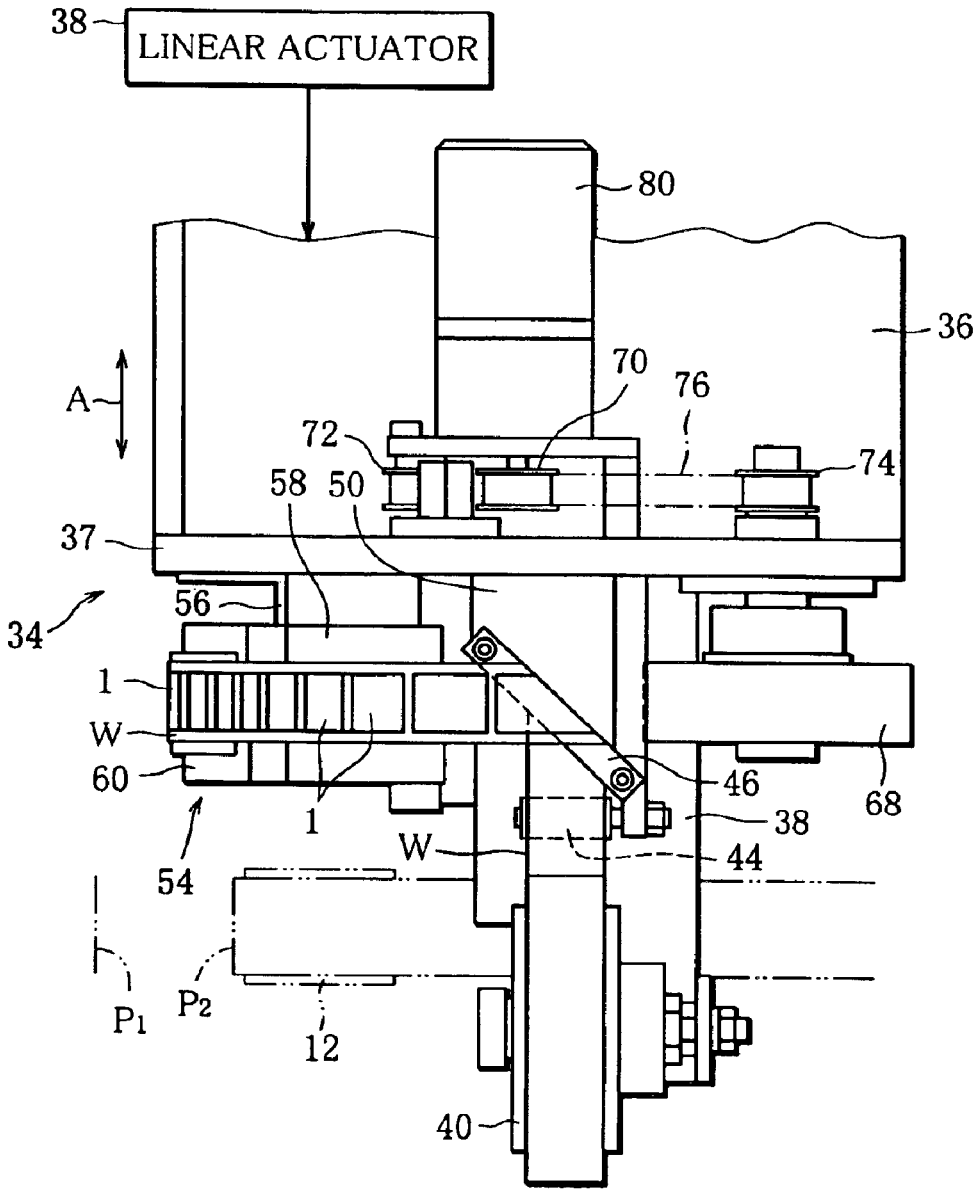
FIG. 2 is a plan view showing a feeding device in FIG. 1.

FIG. 2 illustrates a schematic plan view of the feeding device 34. As mentioned above, the feeding device 34 is situated above the receiving roller 12.

The feeding device 34 comprises a movable base 36, which is mechanically supported by a linear actuator 38. The linear actuator 38 is capable of shifting the movable base 36 on a horizontal plane. More particularly, the movable base 36 can move in a direction of approaching or moving away from a vertical plane including the delivery paths 4 and 10 of the first and second webs $P_1$ and $P_2$, that is, in a direction of an arrow A in FIG. 2.

A reel stage 38 extends from the movable base 36 horizontally toward the sub-delivery path 10. There is disposed a feeding reel 40 at a distal end of the reel stage 38. Wound around the feeding reel 40 is a web-like base material W having a large number of double-faced splicing tapes 1. The double-faced splicing tapes 1 are attached to the base material W at prescribed intervals in the longitudinal direction thereof. The double-faced splicing tapes 1 will be described later in detail.

Figure 3:
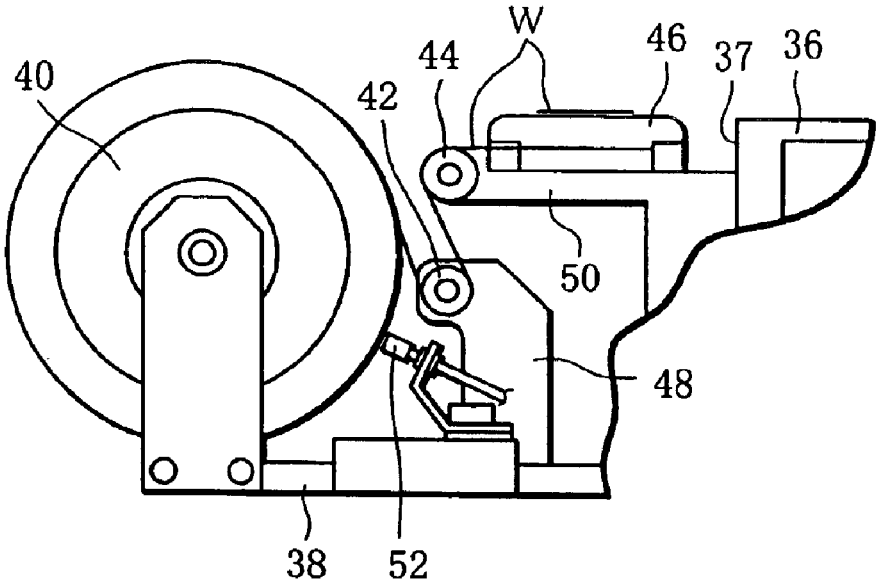
FIG. 3 is a view showing vicinity of a feeding reel of the feeding device.

As illustrated in FIG. 3, the base material W wound around the feeding reel 40 is drawn through guide rollers 42 and 44 and passes a shift bar 46. The shift bar 46 shifts a feeding direction of the base material W by an angle of 90 degrees as is clear from FIG. 2. The guide roller 42 is rotatably supported by the reel stage 38 through with a bracket 48, and the guide roller 44 and the shift bar 46 are each mounted on a support 50 of the movable base 36.

As shown in FIG. 3, a remaining amount-detecting sensor 52 is disposed on the reel stage 38. The remaining amount-detecting sensor 52 optically detects an external diameter of the feeding reel 40, and based on the result of the detection, the remaining amount of the base material W in the feeding reel 40 is measured.

As illustrated in FIG. 2, a feeding guide 54 is situated near the shift bar 46. The feeding guide 54 encourages the feeding of the base material W that has passed the shift bar 46.

More specifically, the feeding guide 54 includes an upper plate 58 and a peeling plate 60. The upper plate 58 and the peeling plate 60 are fixed to upper and lower sides of a bracket 56, respectively. The bracket 56 protrudes from an end wall 37 of the movable base 36 toward the sub-delivery path 10 side.

Figure 4:
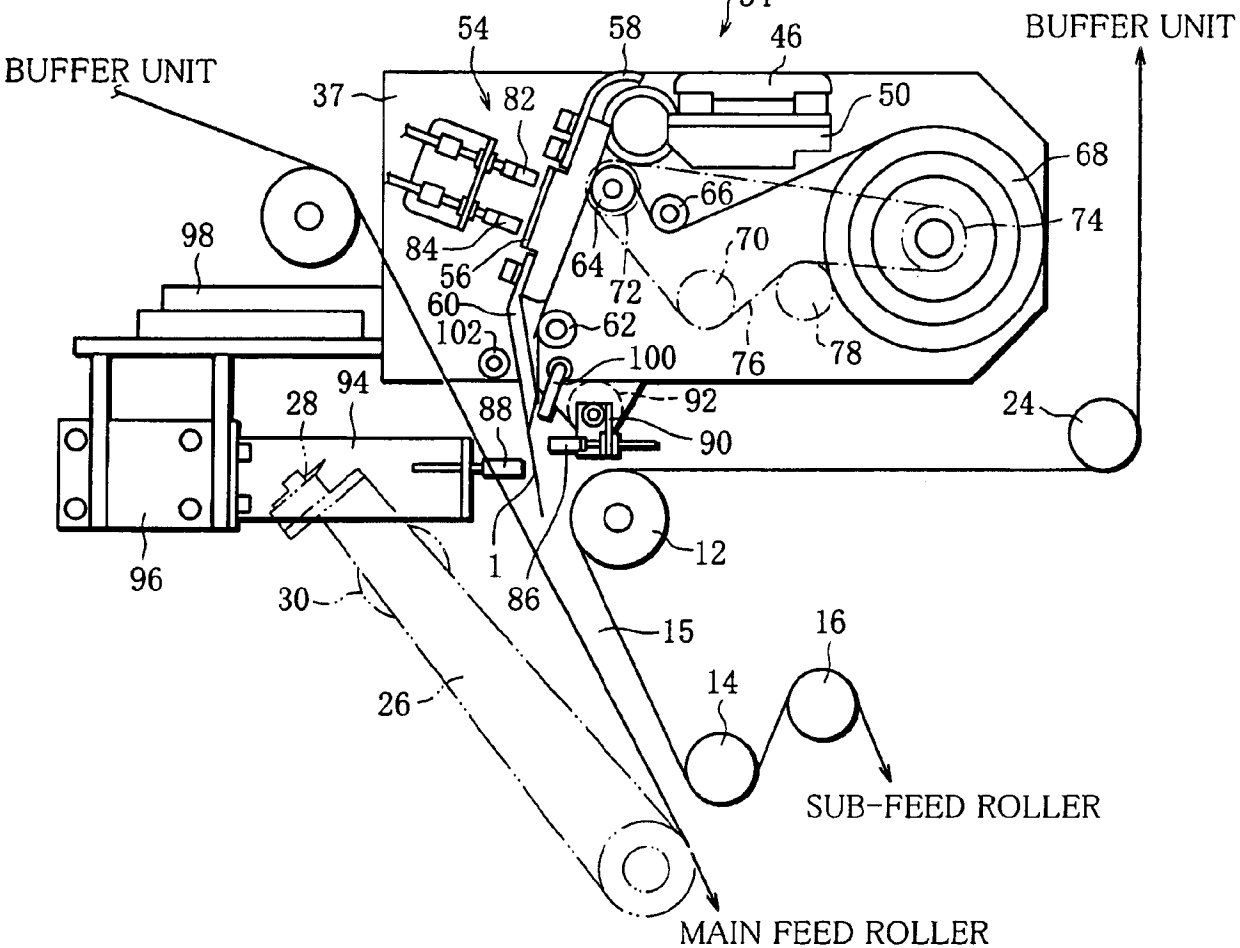
FIG. 4 is a front view of the feeding device.

As is evident from FIG. 4, the upper plate 58 has an upper end portion formed into the shape of a circular arc that is upward convex. On the other hand, the peeling plate 60 has a lower end portion formed as a sharp tip. The sharp tip is directed downward.

After passing the shift bar 46, the base material W is guided by the upper plate 58 and the peeling plate 60 of the feeding guide 54 in order, and is then folded back at the tip of the peeling plate 60. The base material W is subsequently guided through a tension roller 62, a driving roller 64 and a tension roller 66 to a take-up reel 68. The rollers 62, 64 and 66 and the take-up reel 68 are rotatably supported by the end wall 37 of the movable base 36.

The driving roller 64 and the take-up reel 68 are connected to a common driving source via a power transmission path and rotated by the driving source in conjunction with each other. More specifically, as illustrated in FIG. 2, the driving roller 64 and the take-up reel 68 each have shafts that rotatably pass through the end wall 37 of the movable base 36, the shafts being provided with pulleys 72 and 74, respectively. Disposed in between the pulleys 72 and 74 is a driving pulley 70, and a driving belt 76 is passed around on the pulleys 70, 72 and 74. The driving pulley 70 is mounted on an output shaft of a drive motor 80, such as a servomotor or the like, that serves as the common driving source, so that the drive motor 80 can make the driving belt 76 run in one direction through the driving pulley 70. The run of the driving belt 76 causes the driving roller 64 and the take-up reel 68 to rotate in conjunction. The rotation of the driving roller 64 and the take-up reel 68 draws the base material W from the feeding reel 40, and simultaneously winds the base material W around the take-up reel 68. Additionally, a reference numeral 78 in FIG. 4 represents a tension pulley for the driving belt 76.

As illustrated in FIG. 4, there are disposed a pair of verification sensors 82 and 84 in the vicinity of the feeding guide 54. The verification sensors 82 and 84 are located away from each other in the feeding direction of the base material W and optically detect the passing of the double-faced splicing tapes 1 during the feeding of the base material W.

Furthermore, a pair of verification sensors 86 and 88 are also situated below the peeling plate 60 of the feeding guide 54. The verification sensors 86 and 88 are so arranged to sandwich the tip of the peeling plate 60 from both sides thereof and to separate by a predetermined distance in the vertical direction, and optically detect the double-faced splicing tapes 1 hang from the peeling plate 60.

More specifically, the verification sensor 86 is fixed to a piston rod of an air cylinder 92 via a bracket 90. The air cylinder 92 is capable of shifting the verification sensor 86 to between an operating position of the tip side of the peeling plate 60 and a retreating position for retreating from the operating position to the movable base 36 side by extending and contracting thereof.

On the other hand, the verification sensor 88 is also fixed to an air cylinder 96 via a bracket 94. The air cylinder 96 is supported by the movable base 36 through a fixing member 98. The air cylinder 96 is capable of shifting the verification sensor 88 to between an operating position of the tip side of the peeling plate 60 and a retreating position of retreating from the operating position to the movable base 36 side by extending and contracting thereof.

Moreover, an air nozzle 100 is located immediately downstream from the tip of the peeling plate 60 in the feeding direction of the base material W. The air nozzle 100 is supported by the movable base 36 and connected to a pneumatic source. Disposed near the tip of the peeling plate 60 is a cutter receiver 102 that operates in cooperation with the movable cutter 28 of the cutting lever 28. The cutter receiver 102 is formed into the shape of a rod and supported by the movable base 36 on the opposite side of the air nozzle 100.

As is apparent from FIG. 2, during the delivery of the first web $P_1$, the movable base 36 of the feeding device 34 is positioned at a rest position separated from the sub-delivery path 10 by the linear actuator 38. Thus, the feeding guide 54 of the feeding device 34, or the peeling plate 60, is retreated from its position above the receiving roller 12.

In this state, when the remaining amount of the first web $P_1$ of the active roll $R_1$ reaches the prescribed amount or less, the second web $P_2$ is fed from the standby roll $R_2$ as described above. On the other hand, the verification sensors 86 and 88 are located in respective operating positions shown in FIG. 4 at the feeding device 34 side, and the drive motor 80 causes the take-up reel 68 and the driving roller 64 to rotate in conjunction. Along with the rotation of the take-up reel 68 and the driving roller 64, the base material W is fed by given length from the feeding reel 40, and the base material W runs while being guided by the feeding guide 54. As the base material W travels, the verification sensors 82 and 84 can detect the passing of the double-faced splicing tapes 1 on the base material W.

Figure 5:
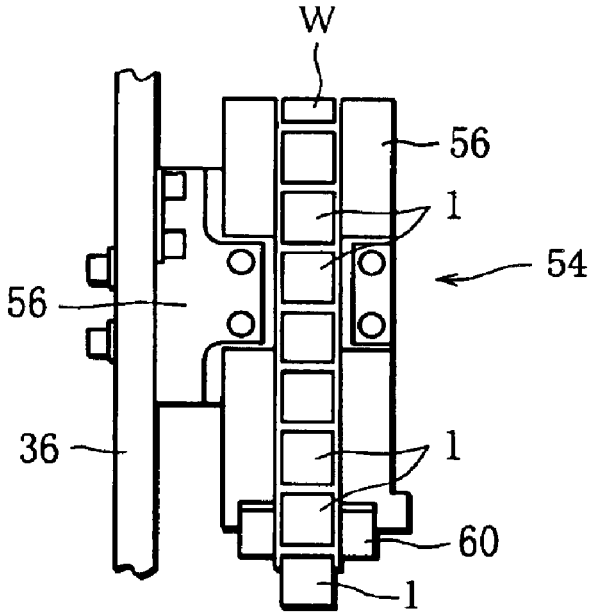
FIG. 5 is a side view of the feeding device.
Figure 6:
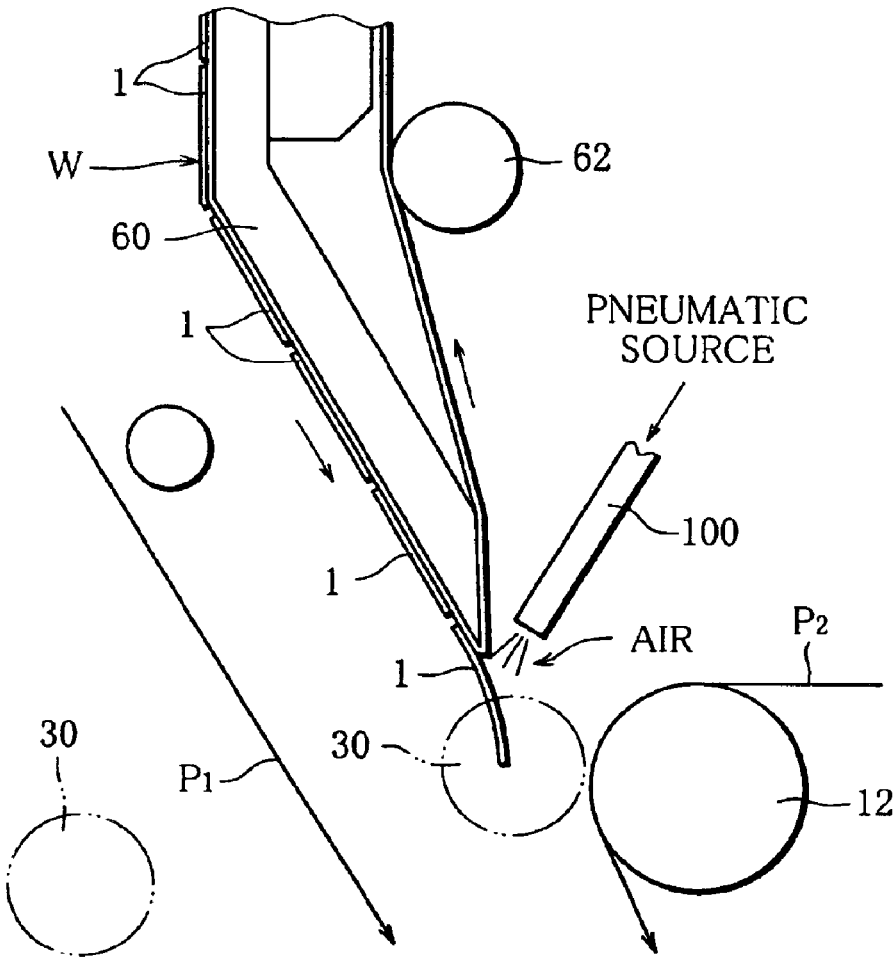
FIG. 6 is an enlarged view showing a peeling plate of a feeding guide in the feeding device.

Along with the travel of the base material W, when passing the tip of the peeling plate 60, the base material W is acutely folded back at the tip of the peeling plate 60. The folding-back of the base material W, as illustrated in FIGS. 5 and 6, peels a double-tip splicing tape 1 off the web material W. After being peeled, the double-tip splicing tape 1 is hung from the tip of the peeling plate 60.

In this case, as shown in FIG. 6, the air nozzle 100 jets air toward the tip of the peeling plate 60, and the jetted air assists the peeling of the double-faced splicing tape 1 off the base material W.

The upper verification sensor 86 detects the hanging of the double-faced splicing tape 1 from the tip of the peeling plate 60, or the peeling thereof, whereas the lower verification sensor 88 detects a hanging amount (drawing amount) of the double-faced splicing tape 1. More specifically, when the lower verification sensor 88 detects the double-faced splicing tape 1, the rotation of the driving roller 64 and the take-up reel 68, that is, the feeding of the base material W, is halted. At this moment, the double-faced splicing tape 1 is maintained with a root end thereof attached to the base material W.

Subsequently, the upper and lower verification sensors 86 and 88 are each retreated from their respective operating positions to their respective retreating positions of the movable base 36 side. The movable base 36 of the feeding device 34 is shifted from the rest position to the sub-delivery path 10, namely the receiving roller 12 side. Thus, the peeling plate 60 of the feeding guide 54 is positioned right above the receiving roller 12, and the double-faced splicing tape 1 hanging from the peeling plate 60 is fed to an inlet of the splicing passage 15, that is, the feeding position located in between the first web $P_1$ and the receiving roller 12. At this point, the verification sensors 86 and 88 have already returned to their respective retreating positions, so that the verification sensors 86 and 88 never interfere with the receiving roller 12, the cutting lever 26 and the first web $P_1$ in the feeding process.

Figure 7:
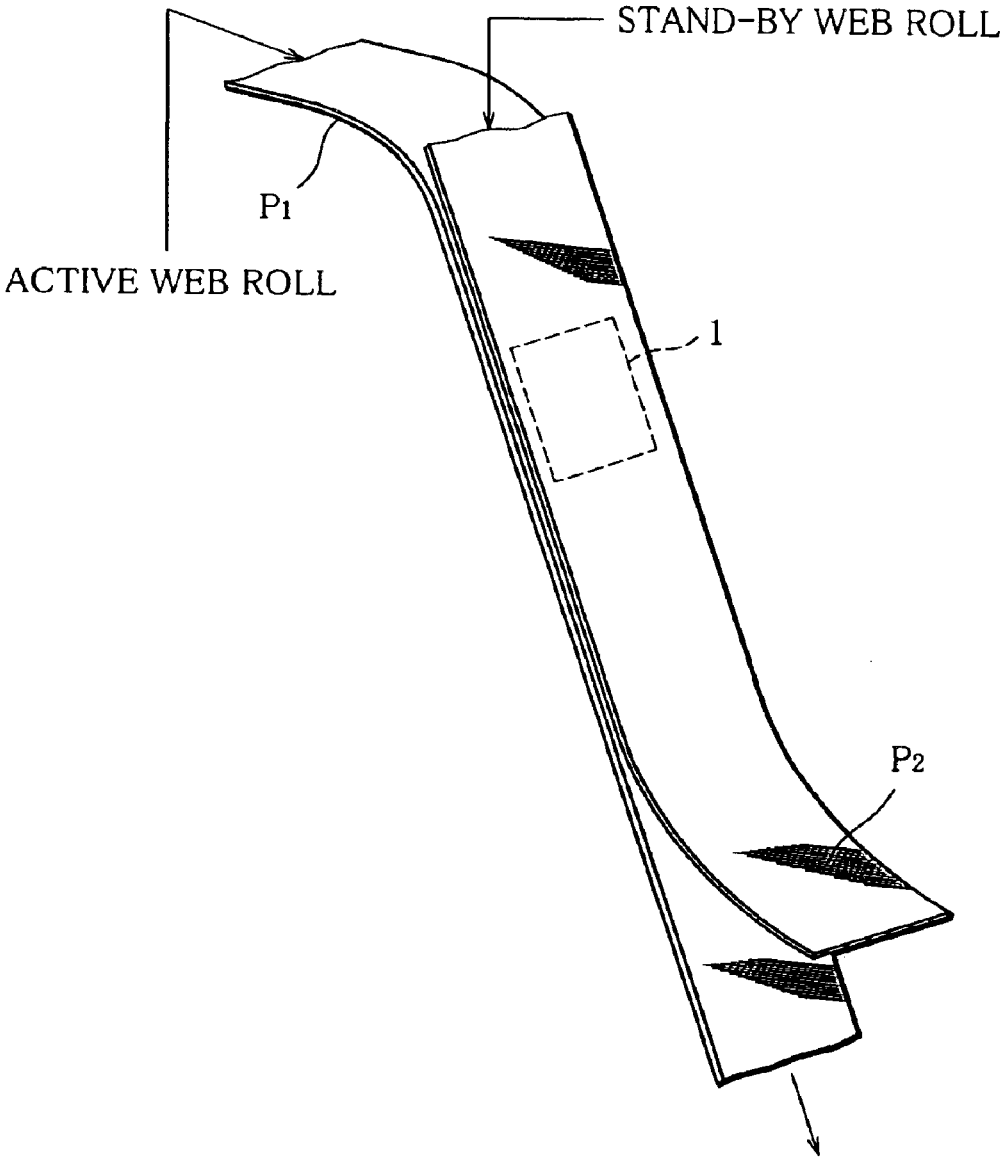
FIG. 7 is a view showing first and second webs spliced to each other with a double-faced splicing tape therebetween.

Thereafter, once the delivery speed of the second web $P_2$ coincides with that of the first web $P_1$, the cutting lever 26 is rotated as mentioned above, and the second web $P_2$ is spliced to the first web $P_1$ with the double-faced splicing tape 1 therebetween as illustrated in FIG. 7, thereby switching the delivery of the webs P from the active roll $R_1$ to the standby roll $R_2$.

The movable base 36 of the feeding device 34 is then returned to the rest position by the linear actuator 38, and the feeding device 34 is put on standby for the next splicing operation.

Figure 8:
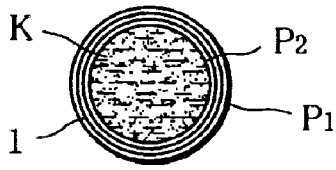
FIG. 8 is a view showing shredded tobacco wrapped in a splicing portion of the first and second webs.

When the splicing portion of the first web $P_1$ and the second web $P_2$ is fed to the wrapping section of the cigarette-manufacturing machine, the splicing portion wraps shredded tobacco K as shown in FIG. 8. A cigarette rod including this splicing portion, however, is a defective product since the web, namely the wrapping paper thereof, has a double structure. The defective cigarette rod is eliminated from a traveling path downstream the cigarette-manufacturing machine.

Since the double-faced splicing tape 1 is peeled off the base material W by means of the tip of the peeling plate 60, it is desirable that the double-faced splicing tape 1 has relatively high rigidity. In other words, if the rigidity of the double-faced splicing tape 1 is high, the double-faced splicing tape 1 is kept in a stable position when the double-faced splicing tape 1 is made to hang from the peeling plate 60. Thus, the double-faced splicing tape 1 in the hanging state is undesirably stuck on neither the first web $P_1$ nor the second web $P_2$, which assures the reliable splicing of the webs $P_1$ and $P_2$.

If the double-faced splicing tape 1 has high rigidity, however, when the shredded tobacco K is wrapped in the splicing portion of the webs $P_1$ and $P_2$ as illustrated in FIG. 8, that is, when the double-faced splicing tape 1 is formed into a cylinder, the double-faced splicing tape 1 produces a great restoring force. If such a restoring force overcomes an adhesive force of the seam of the wrapping paper in the tobacco rod, the seam bursts to be unsealed, precluding the continuous forming of the tobacco rod.

Figure 9:
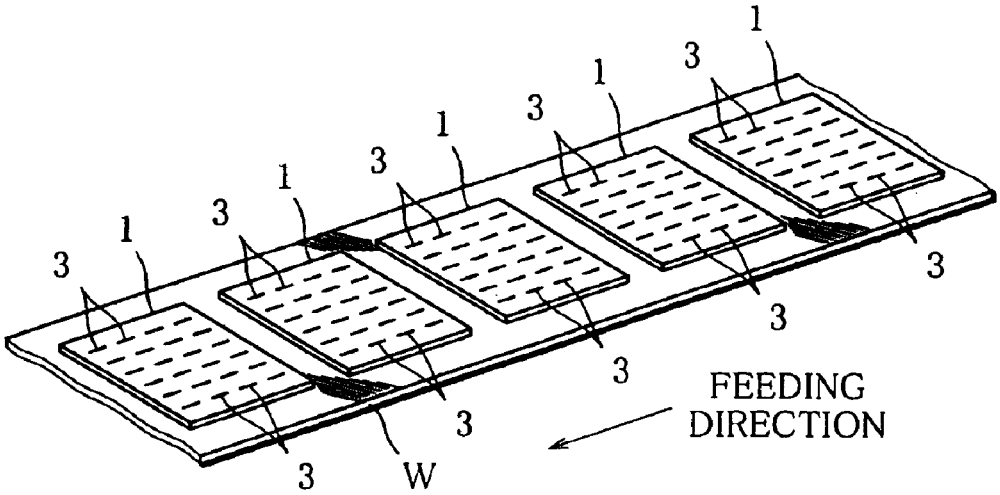
FIG. 9 is a perspective view showing the double-faced splicing tape on a base material.
Figure 10:
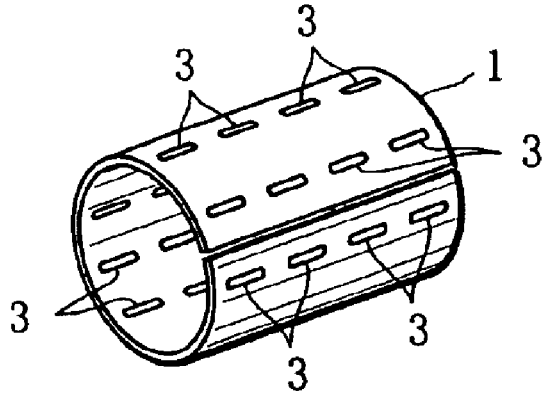
FIG. 10 is a view showing the double-faced splicing tape of FIG. 9 that is formed into a cylindrical shape.

Under these circumstances, the double-faced splicing tape 1 has a plurality of perforations 3 as shown in FIG. 9, and the perforations 3 extend along the feeding direction of the base material W. Such perforations 3 reliably assure the rigidity of the double-faced splicing tape 1 in the feeding direction of the base material W, or in the direction along the longitudinal direction thereof. At the same time, however, the perforations 3 reduce to a large degree the rigidity of the double-faced splicing tape 1 in the direction along the width direction of the base material W. Consequently, as illustrated in FIG. 10, the double-faced splicing tape 1 having perforations 3 is easily formed into a cylinder shape, and the double-faced splicing tape 1 formed in such a manner has a small restoring force, thereby being suitable for the splicing of the first and second webs $P_1$ and $P_2$.

Figure 11:
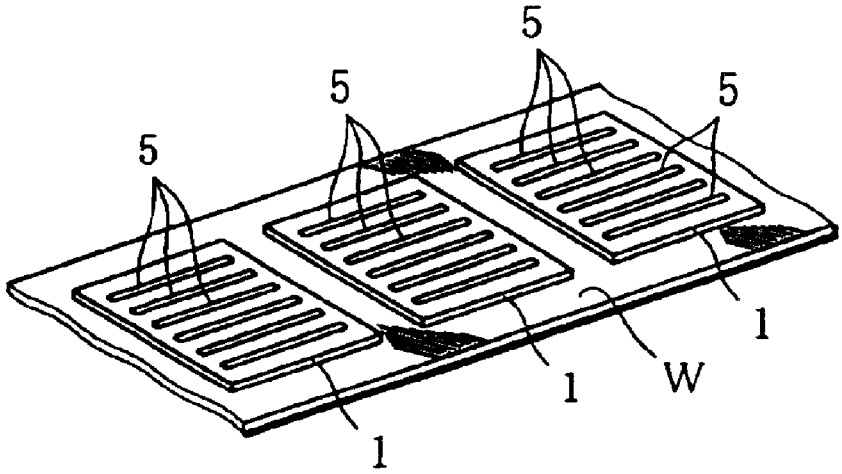
FIG. 11 is a perspective view showing an example of modification to the double-faced splicing tape.

As illustrated in FIG. 11, the double-faced splicing tape 1 may have slits 5 arranged into a plurality of lines instead of the perforations 3. Such slits 5 extend in the longitudinal direction of the base material W to carry out the same functions as the perforations.

The double-faced splicing tape 1 may have a plurality of recession lines or vertical grooves extending in the longitudinal direction of the base material W in stead of having the perforations 3 or the slits 5.

Furthermore, although the feeding device of the present invention is suitable for the automatic splicing device of the aforementioned type, it may be also applied to an automatic splicing device comprising a reservoir.

In addition, the double-faced splicing tape 1 and the feeding device thereof are not limited to use for the splicing of the first and second webs $P_1$ and $P_2$ used for forming a tobacco rod, and may be utilized for the splicing of webs for tip paper used for manufacturing filter cigarettes, the splicing of webs used for forming a filter rod, and the splicing of various webs used for forming rod-like articles other than smoking articles.

What is claimed is:

1. A feeding device of a splicing tape for an automatic splicing device of webs, the automatic splicing device splicing a first web being fed from an active roll along a main delivery path to wrap a filling material into a rod shape and a second web drawn from a standby roll in a stand-by state along a sub-delivery path with a splicing tape fed from said feeding device between the first and second webs, and cutting the first web upstream from a splicing portion of the first web and the second web, the main delivery path and the sub-delivery path each having a feeding position for receiving supply of said splicing tape; said feeding device comprising:

a feeding reel wound with a web-like base material, wherein the base material has a large number of splicing tapes attached thereto at prescribed intervals in a longitudinal direction thereof;

a take-up reel capable of taking up the base material fed from said feeding reel;

a feeding path extending between said feeding reel and said take-up reel to guide the feeding of the base material, said feeding path including a peeling member located above said feeding position, said peeling member having a sharp tip directed to said feeding position, thus peeling one splicing tape off the base material and making said splicing tape hang from the base material toward said feeding position when the base material passes said tip of said peeling member; and driving means for feeding every given length of the base material from said feeding reel by controlling rotation of said take-up reel, wherein said splicing tape has longitudinal rigidity with respect to a direction along a longitudinal direction of the first and second webs and width rigidity with respect to a direction along a width direction of the first and second webs, said width rigidity being smaller than said longitudinal rigidity.

2. The feeding device according to claim 1, wherein said splicing tape is a double-faced splicing tape to be located between the first web and the second web to splice the first and second webs together; and the automatic splicing device feeds the second web at the same speed as a delivery speed of the first web to splice the first and second webs together with said hanging double-faced splicing tape, and cuts the second web downstream from said splicing portion simultaneously with the cutting of the first web.

3. The feeding device according to claim 2, wherein the feeding device further includes an air nozzle located in the vicinity of said tip of said peeling member, said air nozzle jetting air from a downstream side of said tip toward said tip in a feeding direction of the base material.

4. The feeding device according to claim 2, wherein the feeding device has an operating position located right above said feeding position and a retreating position located away from said feeding position.

* * * * *